United States Patent [19]

Juenkersfeld et al.

[11] Patent Number: 4,915,208

[45] Date of Patent: Apr. 10, 1990

[54] CONTAINER-RECEIVER MAGAZINE WITH TWO WORK STATIONS

[75] Inventors: Harald Juenkersfeld, Wuppertal; Georg Fischer, Velbert; Lutz Langenhahn, Ettlingen, all of Fed. Rep. of Germany

[73] Assignee: Benz & Hilgers, GmbH, Duesseldorf, Fed. Rep. of Germany

[21] Appl. No.: 84,535

[22] Filed: Aug. 12, 1987

[30] Foreign Application Priority Data

Sep. 26, 1986 [DE] Fed. Rep. of Germany ..... 3632691

[51] Int. Cl.[4] ..... B65G 37/00

[52] U.S. Cl. ..... 198/346.1; 198/465.1; 198/468.6

[58] Field of Search ..... 198/347, 346.1, 465.1, 198/465.2, 465.3, 468.6; 414/37, 102

[56] References Cited

U.S. PATENT DOCUMENTS 3,598,221 8/1971 Kumaschka et al. ..... 198/468.2
3,889,797 6/1975 Naito et al. ..... 198/347
4,699,583 10/1987 Grigoli et al. ..... 198/465.3 X

FOREIGN PATENT DOCUMENTS 3538993 4/1987 Fed. Rep. of Germany ... 198/465.1

*Primary Examiner*—Robert J. Spar
*Assistant Examiner*—D. Glenn Dayoan
*Attorney, Agent, or Firm*—Klein & Vibber

[57] ABSTRACT

The invention relates to a process and arrangement for exchanging cellular members which are provided with container receiving openings and form part of a filling machine. The cellular members are successively removed from the filling machine and cellular members with an alternate format for receiving containers are essentially simultaneously inserted into the filling machine. This operation is carried out in that an exchange arrangement receives the first formatted cellular members at a first receiving station of a magazine and dispenses alternately formatted cellular members at a second working station of the machine is disposed at a distance from the afore-mentioned receiving station. In this manner it is possible to carry out a cellular member exchange in a very rapid manner and by a very simple process and arrangement.

3 Claims, 2 Drawing Sheets

CONTAINER-RECEIVER MAGAZINE WITH TWO WORK STATIONS

BACKGROUND OF THE INVENTION

A method and arrangement for exchanging container-receivers formed by cellular members of a filling machine, in particular a machine for filling food and beverage products into containers.

The invention relates to a method of exchanging cellular members having container-receiving means in a filling machine, in particular a machine for filling food and beverage products into containers, in which the cellular members are driven by transport means and can, as the need arises, be exchanged with cellular members having container receiving means of a different format. An arrangement and method of the afore-described type is disclosed in the co-assigned German Patent No. 3538993.

When exchanging the products to be dispensed by the filling machine, respectively the format of the to be filled containers, it is necessary not only to readjust the working stations of the container filling machine, but also to exchange the cellular members with new cellular members which are formatted for containers of a different type or shape. It is precisely this exchange of cellular members which is quite time-consuming and, due to the juxtaposed arrangement of the containers in a row, can only be carried out with great difficulties.

Thus, it is not only necessary to remove the cellular members and exchange them with new ones, but also to precisely orient the new cellular members in the filling machine, so that, for example, in the sealing station, wherein the cellular member acts as a backstop for the sealing tool the cellular member is precisely positioned in confronting relationship thereto. Finally there must be assured that during assembly and disassembly no damage to the cellular members themselves and/or their connection to the transport means occurs. Moreover if an exact orientation and therewith a flawfree sealing process is no longer possible, then the imperishable character of the filled product can, under certain conditions, be significantly affected so that the entire production process must be interrupted.

According to the proposal of the afore-mentioned published German co-assigned patent No. P 3538993 investigations have already been made how to produce an improved exchange of the cellular members and how to avoid a damage to such a cellular member as well as how in particular to reduce the exchange time by means of automating the process. This can be achieved by arranging and manipulating together a magazine with a new cellular member, after an exchange, relative to a magazine which receives the to be exchanged cellular member. The insertion and removal of the cellular member results automatically, whereby the magazine can assume the shape of a drum, so that its compact constructional form, which takes up a reduced space, is available and thereby the mounting of the most different cellular members, which can remain in the to be exchanged drum, require very little space. In view of the fact that the exchange and manipulation of the cellular members for purposes of automation is effected by means of suction cups, whereby a reproducible precise positioning within the machine is achieved, there exists the danger, that when the pressurized air level drops the suction cups no longer function properly and thereby the cellular members drop of, so that the safety of operation is considerably reduced. Furthermore, there can be mounted only cellular members of a particular format in the magazine of this known arrangement.

SUMMARY OF THE INVENTION

It is therefore an object of this invention, to propose a method, in which a rapid and above all secure exchange and exact centering of the cellular members is made possible. In addition thereto, the arrangement of this invention is simple in construction and substantially malfunction-free.

The object of the invention is achieved by means of a method wherein the exchange of the cellular members is achieved in removing one after the other cellular members of a first format from the filling machine and essentially simultaneously inserting those cellular members with an alternate format for container reception into the filling machine. The inventive concept resides in that first there is initiated a removal of the cellular members that are mounted in the machine and as soon as the first mounting sites in the transport means of the machine are not all occupied, new cellular members of a different format can be inserted into the filling machine. This can, for example, be achieved in a manner whereby the removal of the first formatted cellular members, can be moved out of the operative path of the transport means after being detached from the transport means in a direction substantially normal to this path and thereafter they are moved substantially in a vertical sense into a deposit position and simultaneously in reverse the cellular members of an alternate format are slidably moved from their deposit position parallel to the plane of the path of the movement of the transport means and thereafter are brought onto the plane of the transport means.

This task of the invention is achieved in accordance with the arrangement of the invention in that the first formatted and alternate formatted cellular members are arranged in the region of the transport means, preferably in its return run plane, respectively in a driven magazine whose feed stroke is dependent on the cadence of the transport means that is the magazine and transport means are driven synchronously.

Since the magazine is constructed as a drum which rotates about an axis which is essentially parallel to the feed plane of the transport means, there can be mounted on a first peripheral portion of the drum the first formatted cellular members and on a second peripheral portion of the drum the alternate formatted cellular members. In this manner one obtains an exchangeable mounting arrangement, in which in a single magazine the first-formatted as well as alternate-formatted cellular members are mounted, so that with the same exchanging arrangement substantially simultaneously the old cellular members can be removed and new cellular members can be inserted. In this arrangement there is, for example, arranged diametrically opposite the receiving position for the delivered first-formatted cellular members of the filling machine the delivery position for the to be delivered cellular members of an alternate format for the filling machine, so that they are disposed substantially in one horizontal plane diametrically opposite each other. The receipt and delivery of the cellular members can, for example, be effected by means of lateral and height-adjustable gripper arms, which are controlled in cadence with the transport means and in accordance with the cadence-run of the drum.

The magazine can, however, also for example be constructed as a double elevator, one elevator of which serves for receipt of the delivered first-formatted cellular members of the filling machine and the other elevator of which serves for the receipt of the to be delivered alternate-formatted cellular members of the filling machine. In this case the gripper arms can be arranged between the elevators, so that the desired simultaneous receipt of old cellular members and the insertion of new cellular members can be effected.

The magazine can be arranged with a drum construction as well as also with the double-elevator construction essentially directly underneath the return-run plane of the transport means, or can also be mounted in front of the machine, and that is, for example, on a magazine cart, so that this also guarantees a rapid exchange of the cellular members. In order for the then, for example, again to be delivered cellular members to the machine to be continuously disposed at the same site, it is advantageous, that the double-elevator is rotatably mounted about a substantially vertical axis when the magazine is constructed as double-elevator. Thereby the cellular members can again be inserted in the filling machine in a precisely oriented position, whereby, in accordance with the invention, a centering arrangement coacts in a support role for orienting the cellular members. This is necessary, since the chains which form the transport means do not have adjustable length, so that without special strips or mechanisms an exact orienting of the cellular members is impossible.

The centering of the arrangement can, for example, consist of a centering bolt which extends through an opening in the cellular member and a guide bolt which coacts with such cellular member.

BRIEF DESCRIPTION OF THE DRAWINGS

Other objects and advantages will appear in the following description, which taken with the drawings, presents in a non-limiting explanation, several embodiments of the invention.

DETAILED DESCRIPTION

Figure 1:
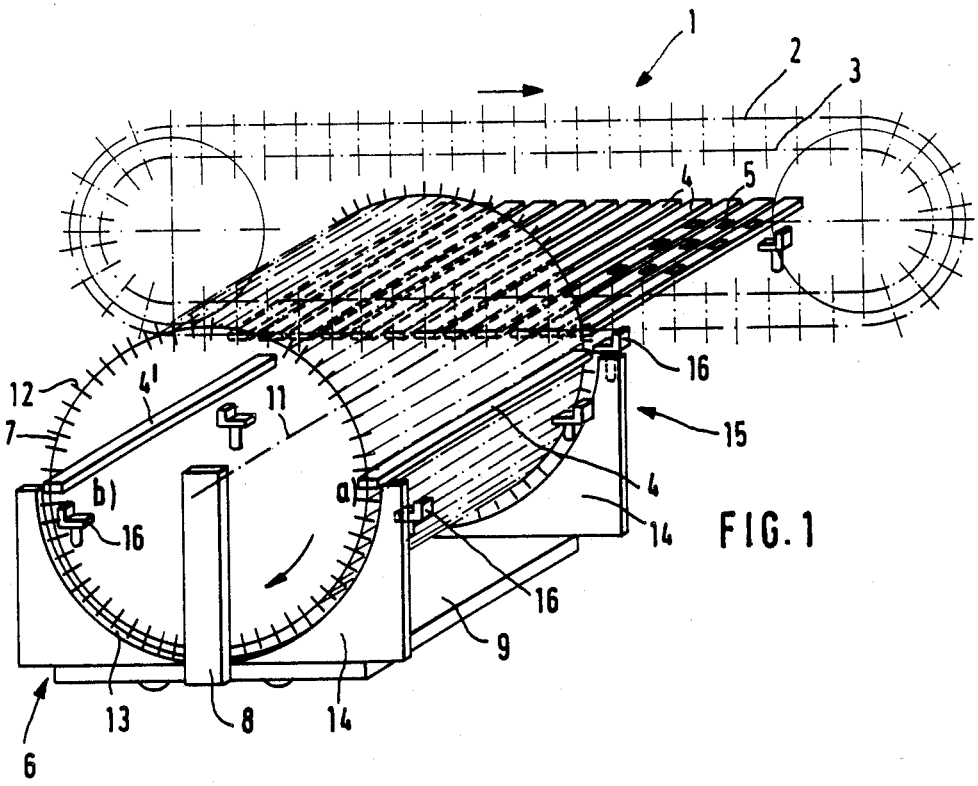
FIG. 1 illustrates schematically in perspective a first embodiment of the exchange arrangement with a magazine in the form of a drum.

In a container filling machine, which is not illustrated in detail in FIG. 1, there is mounted an endless transport means, which rotates in a clockwise direction. The transport means 1 consists of two parallels side by side guide chains 2, 3, which laterally run about non-illustrated wheels and therefore present an upper working plane as well as a return run lower plane. There are disposed above this operative plane the usual work stations of a container filling machine (not illustrated), such as container feed stations, filling stations, cover sheet stations, cover distributor, a sealing station and a lifting station.

As is illustrated in FIG. 1 in perspective there extend between the chains 2, 3, cellular members 4 having receiving openings 5, in which to be filled containers, for example containers made of synthetic material, cardboard, paper, glass or sheet metal or the like, are inserted. During the forward feed movement of the transport means 1 the containers move in accordance with the transport arrangement from left to right through the container filling machine, whereby they move successively underneath and past the above-mentioned working stations. With a production and receiver readjustment the container receiving openings 5 must be dimensioned according to the new container size and in conjunction therewith the cellular members 4 must be exchanged.

The exchanging of the cellular members 4 is carried out with the aid of an exchanging arrangement 6. In the illustrated embodiment such arrangement includes a magazine in the form of a drum 7 which rotates in cadence with the movement of the machine. This drum 7 is mounted on support columns 8 of the movable magazine cart 9. The receiving pockets 12 for the cellular members 4 are equidistantly disposed on the periphery of a substantially horizontally, rotatably mounted drum 7. This drum 7 is rotatable about the axis 11. In order for the cellular members 4 not to fall out from the receiving pockets 12 of the drum of the lower portion of the drum 7 is surrounded by a pair of guide cheeks 14 mounted at the axial end regions of the drum 7, which guide cheeks 14 have semi-circular guide surfaces 13. In order to transport the cellular members 4, 4' between the drum 7, on the one hand, and the transport means 1 of the container filling machine, on the other hand, a manipulator 15 is provided, which in the illustrated embodiment has laterally and height-adjustable gripper arms 16. These gripper arms 16 can be armed with suction cups, plyers and the like elements for purposes of gripping the cellular members 4, 4' and to transport them in the desired manner.

MANNER OF OPERATION

The arrangement of FIG. 1 operates as follows:

With the aid of the gripper arms 16 mounted on the right side of the drum 17 the detachment of the to be gripped cellular member 4 from the transport means 1, is effected in that the cellular member 4 is taken over by the gripper arms 16, is then slightly lowered and thereafter is laterally moved underneath the transport means into a receiving pocket 12 of the drum 7. This means that the receiving station (a) is disposed somewhat about the middle plane of the drum 7. Diametrically opposite to this station on the other side of the drum 7 there is disposed a delivery station (b) for delivering differently formatted cellular members 4' to the filling machine. These differently formatted cellular members 4', which means cellular members having different receiving openings 5, can then be inserted into the machine, respectively be transported to the region of the transport means 1, as soon as there is removed from a first location of the transport means a first formatted cellular member 4 and this location is then freed for receiving a new cellular member 4'. Thereafter there can be simultaneously, in cadence with the operation of the machine, be removed first formatted cellular members 4 from the transport means and newly formatted cellular members 4' by the lateral slidable displacement and lifting of the cellular member with the aid of gripper arms 16 in the region of the transport means 1. From the foregoing there results that the drum 7 can be armed with first formatted as well as with alternately formatted cellular members 4, 4'.

Figure 2:
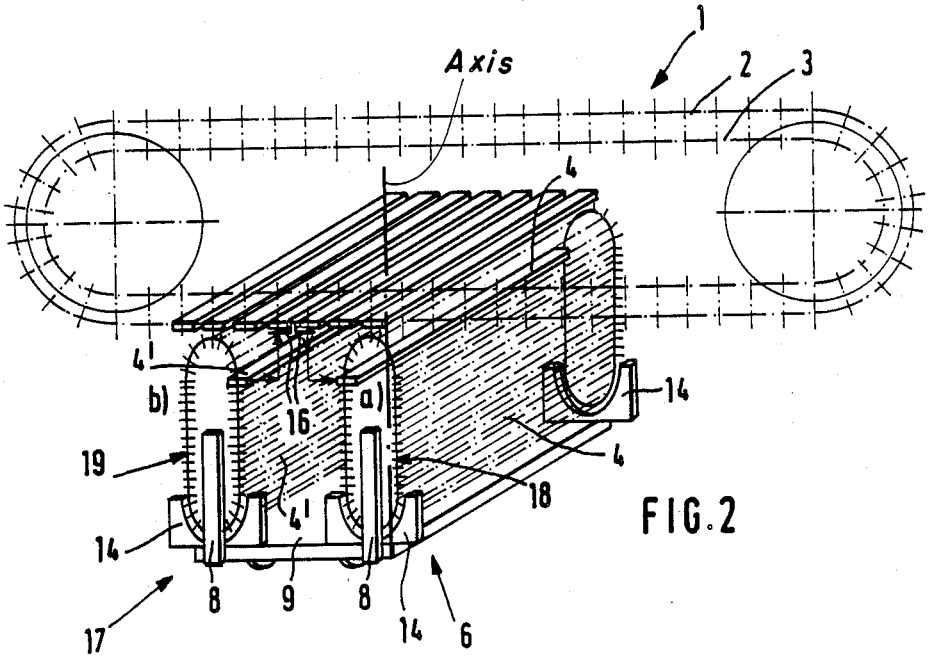
FIG. 2 illustrates schematically in perspective a second embodiment of an exchange arrangement in which the magazine is in the form of a double-elevator.
Figure 3:
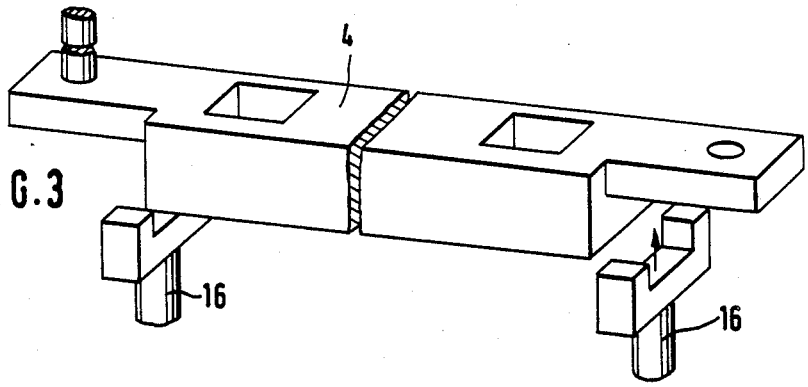
Figure 4:
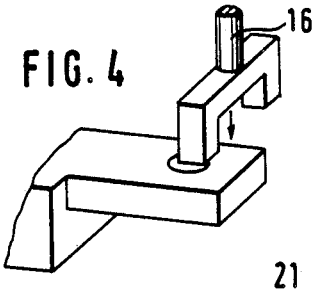
Figure 5:
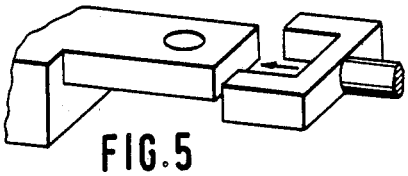
Figure 6:
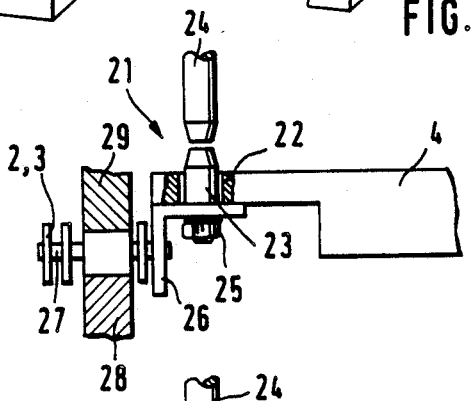
Figure 7:
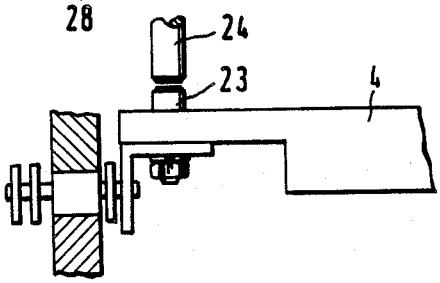
Figure 8:
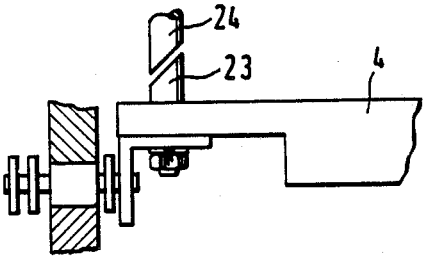

An exchanging arrangement 6 in accordance with FIG. 2 is constructed in principle like the embodiment of FIG. 1. Thus, it can be noted that it also has a receiving station (a) and a delivery station (b). The exchanging arrangement is however not constructed as a rotating drum, but as a double-elevator 17, whereby the one elevator 18 receives the first formatted cellular members 4, and the elevator 19 the alternate formatted cellular members 4'. The double-elevator 17 is also mounted on the movable magazine cart 9 and also here the elevators are supported by columns 8 and have the semi-circular guide cheeks 14 at the axial ends of the elevators 17, 19.

The manner of operation of this modified embodiment is such that via gripper arms 16 first the first-formatted cellular members 4 are lowered and then laterally travel into the elevator 18. Conversely, the alternately formatted cellular members 4' lateral travel out of the elevator 19 and, via the gripper arms 16, are moved upwardly to the transport means 1 of the container filling machine. In view of the fact that the gripper arms 16 are disposed directly adjacent to each other in this arrangement, there can immediately be removed from the beginning a cellular member and simultaneously, after one cadence of the machine, an alternately formatted cellular member be introduced into the machine.

At transfer of the cellular members from the magazine, be it from the drum 7 or from the double-elevator 17, the operation is not completed, rather the cellular members must also be oriented in accordance with the transport means, that is with the chains 2, 3 and must be properly centered.

It is understood that the invention is not limited to the illustrated embodiments but encompasses in spirit and scope variations thereof and the scope of protection afforded by the claims should be interpreted accordingly. Thus, it is possible for drum 7 to be mounted in the embodiment of FIG. 1, essentially also directly in the region of the return run plan of the transport means 1, whereby a somewhat altered control of the gripper arm 16 is necessary. Similarly, in the embodiment of FIG. 2 the double-elevator 17 may be laterally arranged adjacent to the machine. With corresponding control on the gripper arms 16 the cellular members 4 can be taken out of the machine, respectively new cellular members 4 can be inserted into the machine.

Finally, the double-elevator 17 can also still be rotatably mounted essentially about a vertical axis, whereby there is achieved, that the new cellular members can be inserted always again at the same position in the machine. When the cellular member is constructed in a fully symmetrical format, this can of course also be achieved with the aid of the magazine cart which then would have to be correspondingly turned.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. In a filling machine for filling containers with food or beverage products, an improved arrangement for exchanging cellular members having container receiving means, said filling machine having endless driven transport means in which there are detachably mounted cellular members of a first format which are exchanged with cellular members of a second format, the improvement comprising, said cellular members having said first format and said cellular members having said second format are operatively mounted in a rotatable storage drum means, said transport means and said drum means operatively moving in synchronization, said transport means having an upper run plane and a parallel lower run plane, said cellular members having said first format being successively removed from said lower run of said transport means and moved onto said storage drum means moving in cadence therewith by a first pair of gripper means while essentially simultaneously said cellular members having said second format being successively removed from said storage drum means by a second pair of gripper means and inserted into said lower run of said transport means;

said storage drum means being in the form of a magazine which is rotatable about an axis which is parallel to said upper and lower plane runs of said transport means, said drum means having a first peripheral portion in which said cellular members having said first format are operatively mounted and having a second peripheral portion in which said cellular members having said second format are operatively mounted;

said drum means having a cellular member receiving station for those cellular members having said first format which are being removed from said transport means and a cellular member delivery station for those cellular members having said second format which are being inserted into said transport means, said receiving station and said delivery station being disposed in a horizontal plane diametrically opposite each other.

2. The improvement arrangement in a filling machine as set forth in claim 1, said gripper arms which are laterally and vertically adjustably mounted relative to said drum means in said arrangement for coaction with said drum means and for gripping said cellular members.

3. In a filling machine for filling containers with food or beverage products, an improved arrangement for exchanging cellular members having container receiving means, said filling machine having endless driven transport means in which there are detachably mounted cellular members of a first format which are exchanged with cellular members of a second format, the improvement comprising, said cellular members having said first format and said cellular members having said second format are operatively mounted in a rotatable magazine, said transport means and said magazine operatively moving in synchronization, said transport means having an upper run plane and a parallel lower run plane, said cellular members having said first format being successively removed from said lower run of said transport means and moved onto said magazine moving in cadence therewith while essentially simultaneously said cellular members having said second format being successively removed from said magazine and inserted into said lower run of said transport means;

wherein said magazine is in the form of double elevator means, wherein a first one of said double elevator means is constructed for receiving cellular members having said first format which have been delivered by said transport means and a second one of said double elevator means is constructed for receiving cellular members having said second format; and two pairs of adjustable gripper arms operatively mounted in said arrangement between said first and second elevator means, whereby said first format cellular members are synchronously replaced with said second format cellular members by said pairs of gripper arms;

wherein said double elevator means is rotatable about a vertical axis.

* * * * *